US006017158A

United States Patent [19]

Conlan

[11] Patent Number: 6,017,158

[45] Date of Patent: Jan. 25, 2000

[54] APPARATUS FOR REINKING THE RIBBON OF A PRINTER RIBBON CARTRIDGE

[75] Inventor: Joseph P. Conlan, Renton, Wash.

[73] Assignee: Tally Printer Corporation, Kent, Wash.

[21] Appl. No.: 09/149,271

[22] Filed: Sep. 8, 1998

[51] Int. Cl.[7] ..... B41J 31/14

[52] U.S. Cl. ..... 400/197; 400/195; 400/201; 400/202

[58] Field of Search ..... 400/195, 196, 400/196.1, 197, 198, 200, 201, 202, 202.1, 202.2, 202.4

[56] References Cited

U.S. PATENT DOCUMENTS

| | | | |
|---|---|---|---|
| 3,241,522 | 3/1966 | Knight | 400/202.2 |
| 3,621,968 | 11/1971 | Kondur, Jr. | 400/195 |
| 3,981,387 | 9/1976 | Gottschlich | 400/196 |
| 4,153,378 | 5/1979 | Scherrer et al. | 400/196.1 |
| 4,209,261 | 6/1980 | Bell et al. | 400/196.1 |
| 4,210,403 | 7/1980 | Mazouet et al. | 400/196.1 |
| 4,247,209 | 1/1981 | Carlson et al. | 400/202.4 |
| 4,469,457 | 9/1984 | Chida et al. | 400/208 |
| 4,968,161 | 11/1990 | Kunitomi et al. | 400/197 |
| 5,005,997 | 4/1991 | Chung | 400/197 |
| 5,015,108 | 5/1991 | Paterra et al. | 400/197 |
| 5,059,045 | 10/1991 | Mrvos et al. | 400/197 |
| 5,230,575 | 7/1993 | Kulesa et al. | 400/197 |
| 5,275,495 | 1/1994 | Wilson, III | 400/197 |
| 5,466,073 | 11/1995 | Rossi et al. | 400/197 |
| 5,511,888 | 4/1996 | Beach | 400/197 |
| 5,570,963 | 11/1996 | Gill | 400/197 |
| 5,605,402 | 2/1997 | Uggetti | 400/197 |
| 5,685,653 | 11/1997 | Bringhurst | 400/197 |
| 5,690,438 | 11/1997 | Tan et al. | 400/197 |
| 5,713,677 | 2/1998 | Petoskey | 400/197 |
| 5,758,979 | 6/1998 | Chen | 400/197 |

FOREIGN PATENT DOCUMENTS

| | | | |
|---|---|---|---|
| 403710 | 12/1990 | European Pat. Off. . | |
| 28 16 714 | 10/1978 | Germany . | |
| 56-130385 | 10/1981 | Japan . | |
| 58-201687 | 11/1983 | Japan . | |
| 60-21283 | 2/1985 | Japan . | |
| 1-317783 | 12/1989 | Japan . | |
| 2-34379 | 2/1990 | Japan . | |
| 5-16505 | 1/1993 | Japan . | |
| 5-139007 | 6/1993 | Japan . | |
| 5-201109 | 8/1993 | Japan | 400/202.2 |
| 6-64290 | 3/1994 | Japan . | |
| 2 226 527 | 4/1990 | United Kingdom . | |
| 94/25280 | 11/1994 | WIPO . | |

*Primary Examiner*—Ren Yan
*Assistant Examiner*—Leslie J. Grohusky
*Attorney, Agent, or Firm*—Christensen O'Connor Johnson & Kindness PLLC

[57] ABSTRACT

An improved apparatus for reinking a ribbon of a printer ribbon cartridge provides a selected reinking pattern across the width of the ribbon. A porous member in contact with a source of ink has a height equal to a distance between a first edge of the ribbon and a distal edge of a double strike zone of the ribbon. The porous member is in contact with a transfer roller, which in turn is in contact with the ribbon. The ribbon moves through the printer cartridge along a path of a Möbius loop. As the ribbon passes the transfer roller for the first time, ink is provided to a single strike zone and to the double strike zone of the ribbon. As the ribbon passes the transfer roller for the second time, the ribbon is reversed given the pattern of the Möbius loop, and ink is provided again to the double strike zone, as well as to the other single strike zone. Twice as much ink is therefore applied to the double strike zone as to each of the single strike zones. More than twice as much ink is provided to the double strike zone by further providing slots circumferentially around the transfer roller in a selected pattern. Desired ratios of ink transfer to different regions of the ribbon are also achieved by forming a porous member of segments having varying firmness, by chamfering an outer surface of the porous member and/or the transfer roller, and by selectively texturizing the transfer roller. Undesirable effects of gravity are overcome by positioning the porous member and transfer roller to contact the ribbon while the ribbon is in a horizontal orientation.

20 Claims, 6 Drawing Sheets

APPARATUS FOR REINKING THE RIBBON OF A PRINTER RIBBON CARTRIDGE

FIELD OF THE INVENTION

This invention relates to apparatus for reinking a ribbon, and more particularly, to apparatus for reinking a ribbon of a printer ribbon cartridge.

BACKGROUND OF THE INVENTION

Many types of printers use a cartridge that contains a printer ribbon saturated with ink. Typically, the printer ribbon is in the form of a continuous loop that is withdrawn from one arm of a cartridge and returned to the opposite arm of the cartridge by a drive mechanism, such that an exposed length of ribbon extends between the two arms of the cartridge between print hammers and a printing surface. As the ink contained in the ribbon is depleted, the print quality becomes lighter, and eventually is unacceptable. However, the ink contained in the ribbon is typically depleted before the ribbon wears out. Therefore, many ribbon cartridges contain a reinking system to continuously provide ink to the ribbon as the ribbon moves through the cartridge.

Conventional reinking systems typically consist of a circular, rotating sponge that is saturated with ink. The sponge is in frictional contact with a transfer roller, which in turn is in frictional contact with the ribbon. As the transfer roller rotates, it draws a film of ink from the sponge and deposits it on the ribbon. Typically, the width or height of the sponge and transfer roller are the same as the width of the ribbon, such that ink is provided uniformly across the width of the ribbon.

However, some printers, such as dot matrix line printers, use two rows or banks of hammers, which allow them to print two lines of data simultaneously. As the printer ribbon moves between the banks of hammers and the print medium, the ribbon is angled across the banks to utilize the majority of the ribbon width, while leaving a small edge margin that is not impacted by the hammers to protect the sensitive edges of the ribbon. As a result, three print zones are created on the ribbon. The center zone of the ribbon is impacted by both rows of hammers, and is referred to as a "double strike zone." Zones on either side of the double strike zone, adjacent opposing edges of the ribbon, are impacted by only one of the upper and lower banks of hammers. These two zones are therefore commonly referred to as a "single strike zone." As a result, twice as much ink is extracted from the double strike zone as from each of the single strike zones in a given period of time. The use of ink therefore varies across the width of the ribbon, although conventional reinking systems replenish ink to the ribbon in a uniform manner across the width of the ribbon.

Accordingly, there is a need in the art for an improved system for reinking a ribbon of a printer ribbon cartridge, and in particular, a reinking system that provides a selected, variable profile of ink across the width of a printer ribbon. The present invention fulfills these needs, and provides further related advantages.

SUMMARY OF THE INVENTION

Briefly, the present invention provides an improved apparatus for reinking a ribbon of a printer ribbon cartridge. In a preferred embodiment of the present invention, the reinking apparatus includes means for providing a selected reinking pattern across the width of the ribbon. For example, it is often desirable to provide twice as much ink to a double strike zone of the ribbon as to either of two single strike zones of the ribbon, as described previously.

In a preferred embodiment, the ribbon moves through a printer ribbon cartridge along a path of a Möbius loop. A porous member, such as a sponge, is in contact with a source of ink and with a transfer roller, which in turn is in contact with the ribbon. The width or height of an outer surface of the porous member is equal to a distance between a first edge of the ribbon and a distal edge of the double strike zone, the porous member providing ink to the transfer roller and in turn to the ribbon along the width of the porous member. As the ribbon moves past the transfer roller, ink is provided to one of the single strike zones and to the double strike zone. Because the ribbon is in the form of a Möbius loop, it reverses top to bottom on each pass through the cartridge and thus will be in a reversed orientation during its second pass by the transfer roller. During the second pass, ink will again be provided to the double strike zone, as well as to the other single strike zone. As a result, twice as much ink is provided to the double strike zone as to each of the single strike zones.

In accordance with another preferred embodiment of the present invention, more than twice as much ink is provided to the double strike zone as to each of the single strike zones. This is accomplished by providing a plurality of slots circumferentially around the outer edge of the transfer roller. Each of the slots extends laterally inward from an edge of the transfer roller and has a length equal to a distance between the first edge of the ribbon and a distal edge of the first single strike zone. The slots are spaced around the outer surface of the transfer roller in a selected manner to achieve a desired proportion of ink transfer to the double strike zone as compared to each of the single strike zones.

In another preferred embodiment of the present invention, the outer surface of the porous member is provided with a first circumferential region adjacent a first edge of the porous member, a second circumferential region adjacent a second edge of the porous member, and a third circumferential region extending laterally between the first and second circumferential regions. The first, second and third circumferential regions are made of materials having a selected firmness, to provide a desired profile of ink transfer to the ribbon. In a preferred embodiment, the first and second circumferential regions are firmer than the third circumferential region, such that more ink is provided to the double strike zone than to each of the first and second single strike zones.

In another preferred embodiment of the present invention, the profile of the outer surface of the transfer roller and/or the profile of the outer surface of the porous member are tailored to provide a desired reinking profile. By chamfering the transfer roller and/or the sponge, a varying distribution of pressure exists along the interface between the transfer roller and the porous member, resulting in a varying ink transfer profile. In a preferred embodiment, the outer surface of the transfer roller is chamfered on either side of a central region. As a result, pressure applied between the porous member and the transfer roller varies along the width of the transfer roller, with greater pressure being applied in the central region than in the regions on either side of the central region. As a result, more ink is applied to the double strike zone of the ribbon than to either of the first and second single strike zones.

In another preferred embodiment of the present invention, the texture of an outer surface of a central region of the transfer roller is rougher than the surface texture of regions on either side of the central region, such that more ink is applied to the double strike zone of the ribbon than to either of the single strike zones. If it is desired to provide even more ink to the double strike zone, the central region of the transfer roller is made rougher.

In yet another preferred embodiment of the present invention, the ribbon moves into a horizontal orientation for a period of time as the ribbon moves past a Mobius loop gate provided in the printer ribbon cartridge. The transfer roller and porous member are positioned beneath the ribbon, such that the transfer roller contacts the ribbon while the ribbon is in the horizontal orientation. Given the relative vertical relationship of the porous member, transfer roller, and ribbon, ink moves upward through the porous member against gravity, and is transferred from a top surface of the porous member to the ribbon by the transfer roller, while the ribbon is in the horizontal orientation. This embodiment is particularly useful with relatively wide ribbons because it overcomes problems associated with reinking a wide ribbon with conventional vertically oriented reinking systems. In particular, when reinking a wide ribbon with a vertically oriented transfer roller, gravity causes ink to migrate toward the lower edge of the ribbon, causing an uneven and undesirable ink distribution, with a higher concentration of ink in a lower region of the ribbon. The horizontal orientation of the inking system provided in accordance with a preferred embodiment of the present invention may be used in combination with the other preferred embodiments described above, to achieve a selected profile of ink transfer to the ribbon.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE INVENTION

Figure 1:
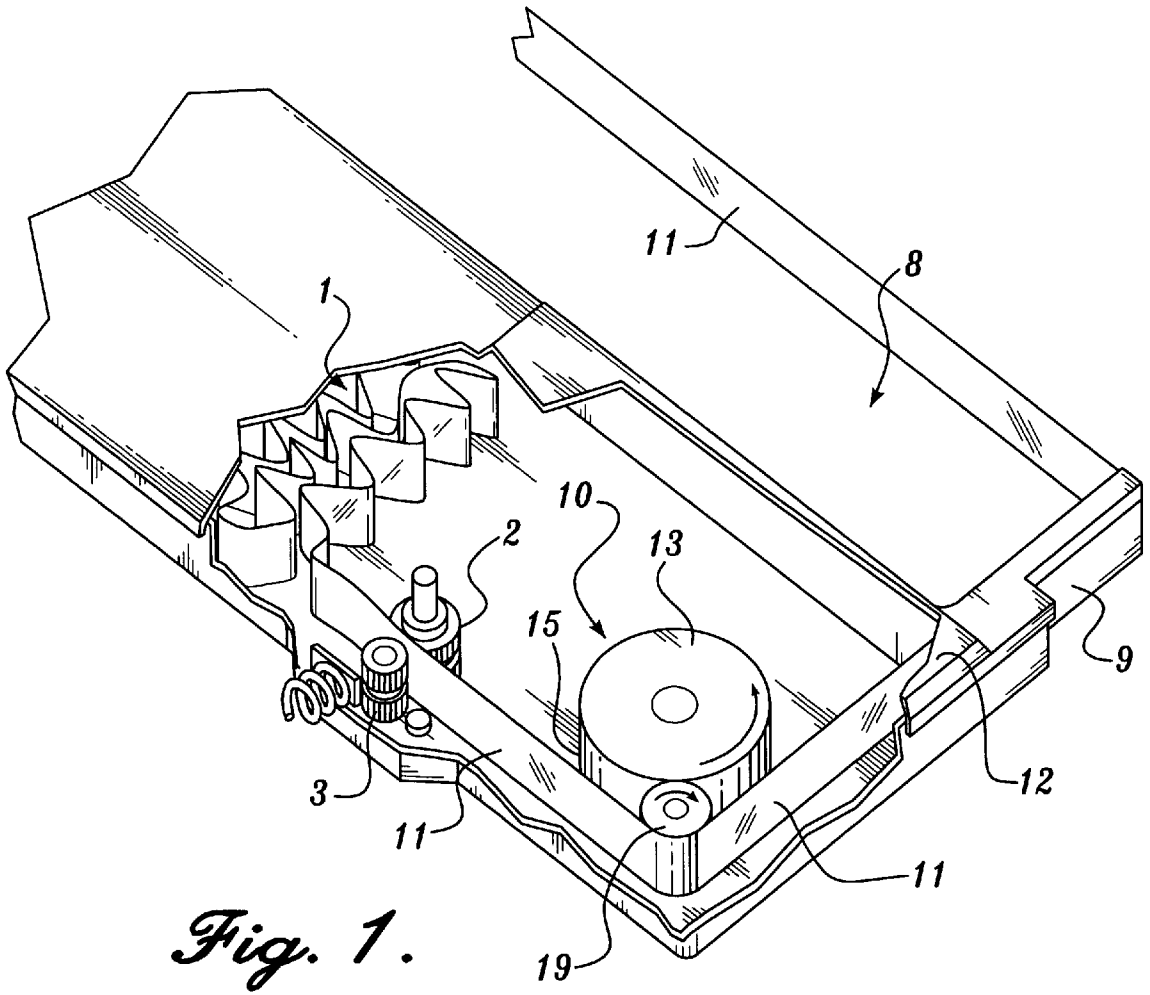
FIG. 1 is a partially cut-away isometric view of a printer cartridge including a reinking apparatus provided in accordance with a preferred embodiment of the present invention.

An improved apparatus for reinking a ribbon of a printer ribbon cartridge is provided in accordance with a preferred embodiment of the present invention. As illustrated in FIG. 1, an exposed length of printer ribbon 11 extends between a first ribbon guide 9 and a second ribbon guide (not shown) and is spaced from the printer cartridge 12 to create a space 8 in which printer hammerbank(s) (not shown) are positioned to strike the ribbon against a print medium. The ribbon 11 is in a continuous loop, and is drawn into cartridge 12 through ribbon guide 9 by a drive mechanism comprising driver roller 2 and opposing pinch roller 3. As is well known in the art, as the ribbon 11 is drawn into the printer cartridge 12, it collapses into stuff box 1, after which it is pulled from the far end of the cartridge through the second ribbon guide (not shown). As the ribbon 11 moves in a continuous loop, it is drawn past the inking assembly 10 having a porous member 13 and transfer roller 19. In a preferred embodiment, the porous member 13 is saturated with ink. As the transfer roller 19 and porous member 13 rotate in opposing directions, the transfer roller gathers a film of ink from the outer surface 15 of porous member 13, and deposits it on the ribbon 11. The configuration of porous member 13 and transfer roller 19 will be described below in greater detail. (Although numerous alternative embodiments for the configuration of the porous member and transfer roller will be described, the porous member will generally be referred to by reference numeral 13 throughout, and the transfer roller will generally be referred to by reference numeral 19 throughout.)

Figure 2:
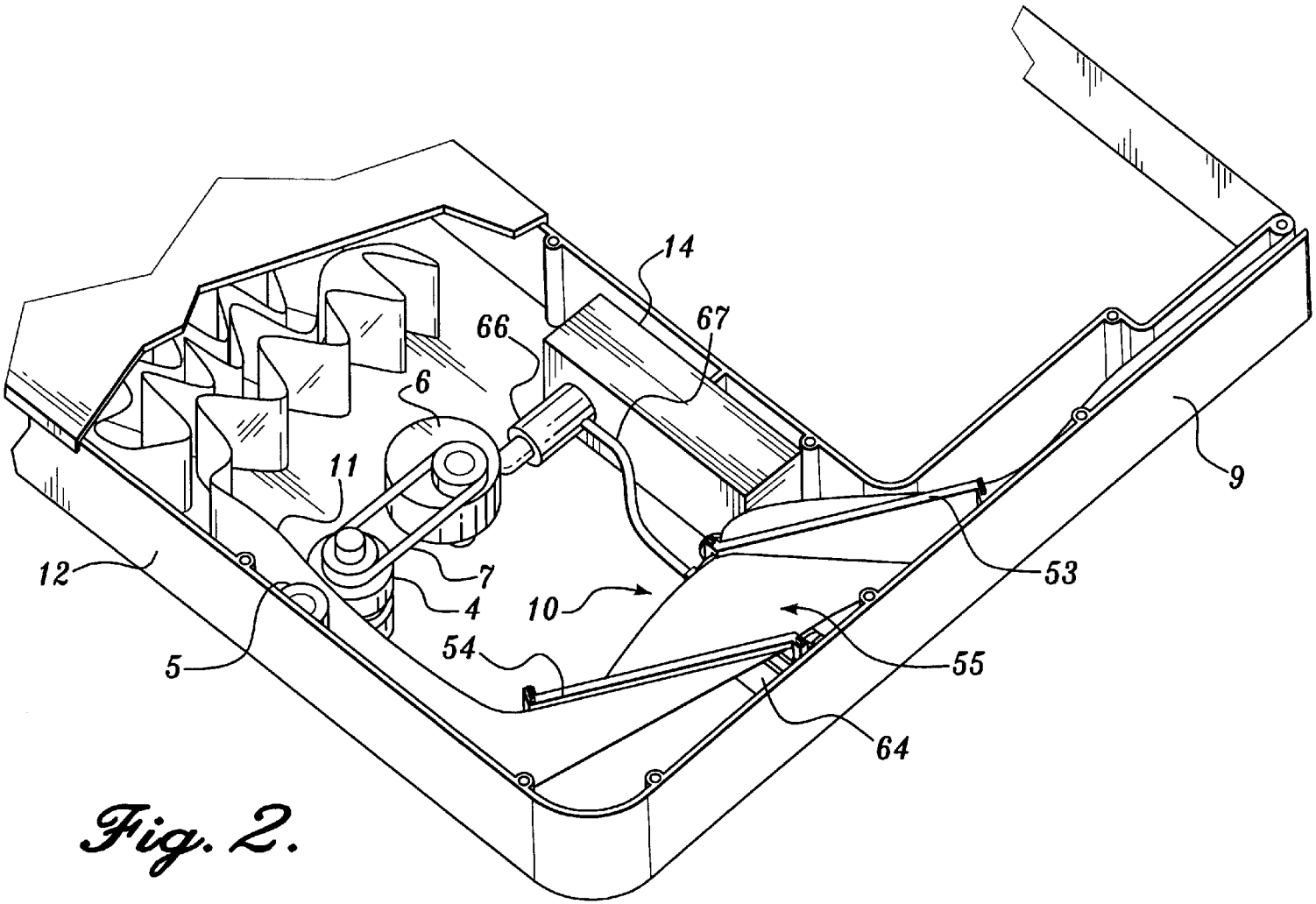
FIG. 2 is a partially cut-away isometric view of a printer cartridge including a reinking apparatus provided in accordance with an alternative embodiment of the present invention.

An alternative embodiment is illustrated in FIG. 2, wherein the ribbon 11 is drawn into printer cartridge 12 via ribbon guide 9 by a drive mechanism comprising drive roller 4 and pinch roller 5. The drive assembly is coupled to an eccentric 6 via drive belt 7, which in turn is coupled to pump 66. Pump 66 draws ink from an ink source 14 and feeds it to a porous member via shaft 67, as described in U.S. Pat. No. 5,511,888, which is commonly owned by the assignee of the present invention.

Figure 3:
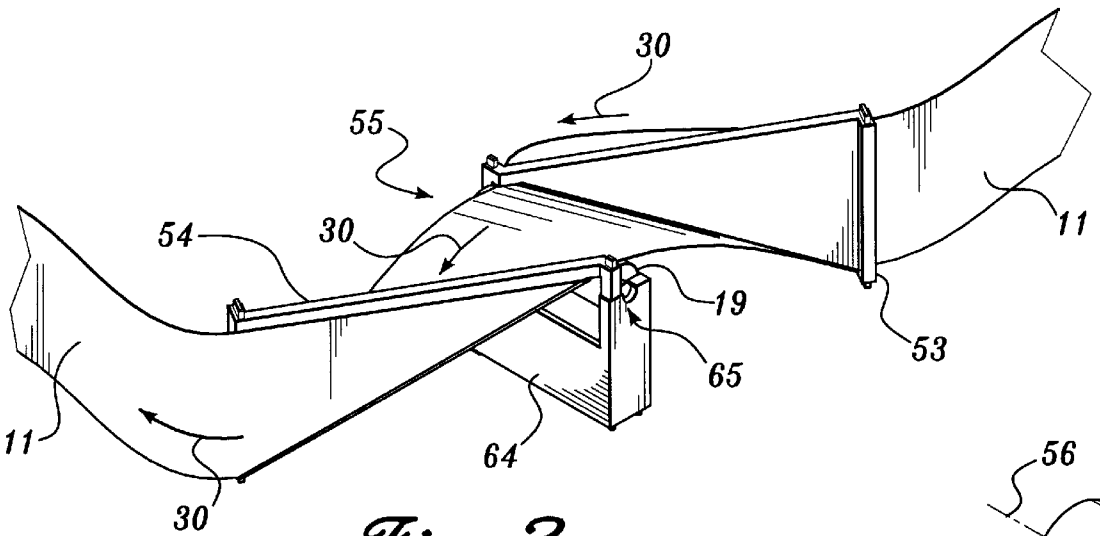
FIG. 3 is an isometric view of the reinking apparatus shown in the printer cartridge of FIG. 2.

In a preferred embodiment illustrated in FIGS. 2 and 3, the printer ribbon 11 follows a path 30 of a Möbius loop. More particularly, the ribbon 11 turns 90° when it encounters a first Möbius loop gate 53, such that the ribbon moves into a substantially horizontal orientation 55 for a period of time, after which ribbon 11 encounters a second Möbius loop gate 54 which causes the ribbon to again rotate 90°.

Figure 4:
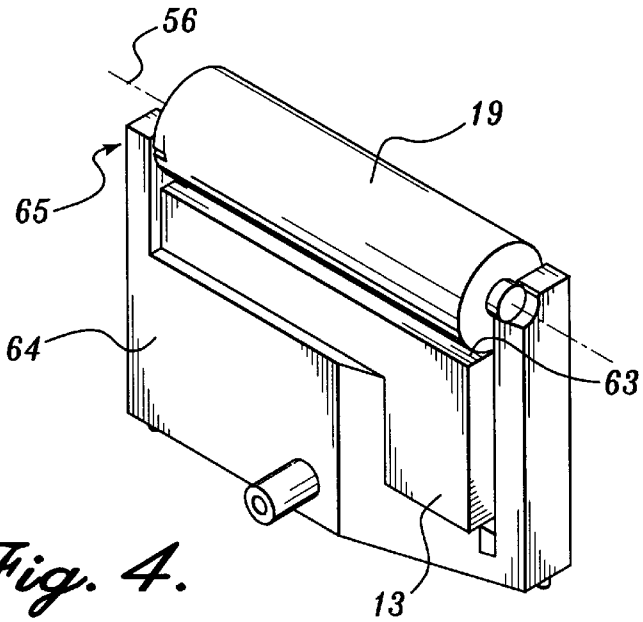
FIG. 4 is an enlarged, partially cut-away isometric view of a portion of the reinking apparatus illustrated in FIG. 3.

In a preferred embodiment, as illustrated in FIGS. 3 and 4, a porous member 13 is provided in a box 64 and is stationary. A transfer roller 19 is coupled to an upper region 65 of the box. The transfer roller 19 is positioned to rotate about a substantially horizontal axis 56 and to contact the ribbon 11 while the ribbon is in the horizontal orientation 55. The box 64 containing porous member 13 and transfer roller 19 is positioned beneath the ribbon, such that a quantity of ink moves upward through the porous member 13 against gravity, and is transferred from a top surface 63 of porous member 13 to the ribbon 11 by the transfer roller while the ribbon is in the horizontal orientation 55.

A reinking assembly provided in accordance with this preferred embodiment of the present invention is particularly well suited for reinking a relatively wide ribbon, for example, one having a width of more than one inch. More particularly, wide ribbons are traditionally hard to reink using a vertically oriented apparatus, because gravity causes the ink to pool toward the lower region of the ribbon, providing an uneven and undesirable distribution of ink. By orienting the reinking apparatus in a horizontal position to contact the ribbon as it moves through the Möbius loop gates, the undesirable effects of gravity are eliminated.

Furthermore, by positioning the porous member containing ink beneath the transfer roller and the ribbon, better control of the rate of ink transfer is achieved, particularly if ink is provided to the porous member 13 via a pump, as illustrated in FIG. 2. As best seen in FIG. 3, the Möbius loop gates 53 and 54 may also be coupled to the upper region 65 of box 64, to create an assembly that ensures the accurate position of the transfer roller relative to the path of the ribbon.

Figure 5:
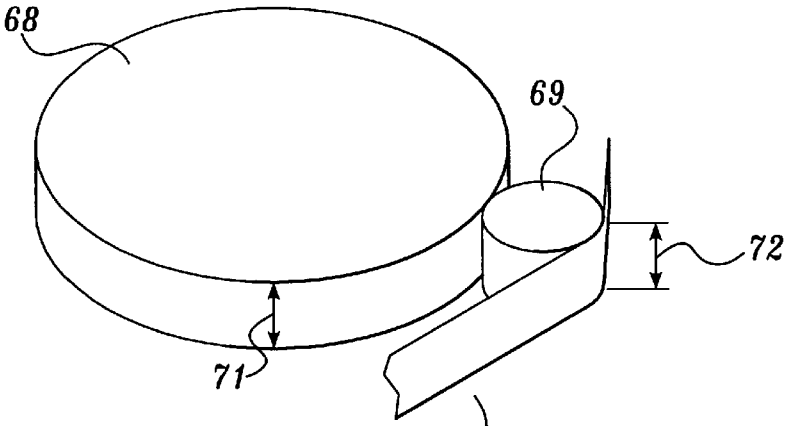
Fig. 5. (PRIOR ART)
FIG. 5 is an isometric view of a prior art reinking apparatus.

In conventional prior art systems, such as that illustrated in FIG. 5, the height or width 71 of a sponge 68 saturated in ink is equal to the height 72 of the transfer roller 69 and width of ribbon 70. In such a conventional system, transfer roller 69 has a smooth outer surface, such that a uniform film of ink is transferred from sponge 68 across the width of ribbon 70. While such a configuration is suitable for reinking relatively narrow ribbons or ribbons that are used in printers having only a single bank of hammers, such a reinking system has disadvantages when used to reink a ribbon used in a printer having two hammerbanks.

Figure 6:
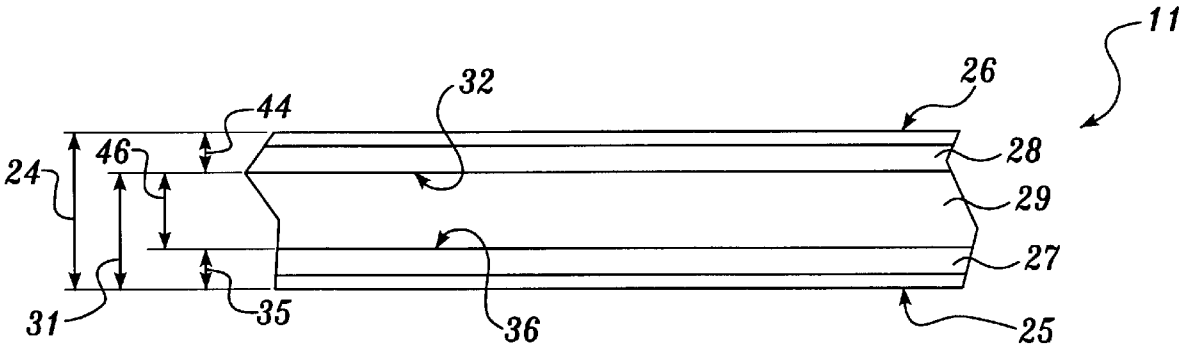
FIG. 6 is a front elevational schematic illustration of a printer ribbon.

As illustrated in FIG. 6, a ribbon used in a printer having two rows or banks of hammers has a width 24 extending from a first edge 25 to a second edge 26. Given the location and orientation of the hammerbanks relative to the ribbon, the striking of the hammers against the ribbon creates a first single strike zone 27 adjacent the first edge 25 of the ribbon, and a second single strike zone 28 adjacent the second edge 26 of the ribbon. (A slight margin along each edge of the ribbon, on the order of 0.080 inches, is not printed on to protect the sensitive edges of the ribbon from damage, and to extend the ribbon's printing life.) A double strike zone 29 extends laterally between the first and second single strike zones. As may be inferred from the names of the zones, the single strike zones 27 and 28 are only struck by one of the lower and upper banks of hammers, while the double strike zone 29 is struck by both banks of hammers. Ink is therefore depleted from the double strike zone 29 approximately twice as fast as ink is depleted from the single strike zones. Therefore, it is desirable when reinking a ribbon used with dual hammerbanks to provide more ink to the double strike zone than to each of the single strike zones.

Figure 7:
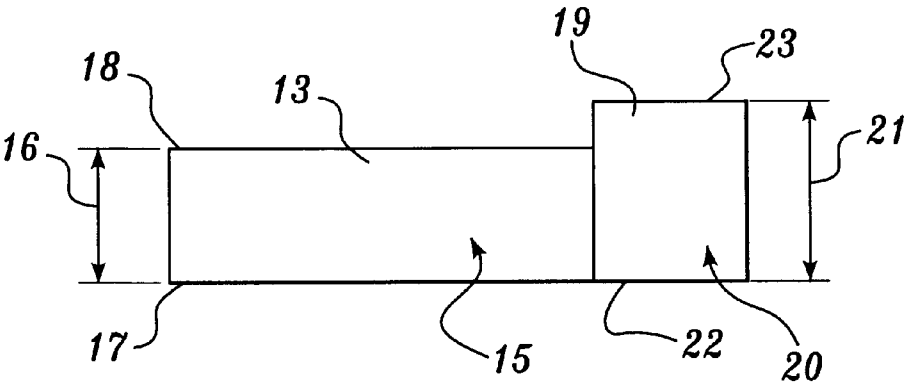
FIG. 7 is a front elevational view of a reinking apparatus provided in accordance with a preferred embodiment of the present invention.

Although a variety of ink transfer profiles may be achieved in accordance with the preferred embodiments of the present invention, it is often desirable to provide twice as much ink to the double strike zone as to each of the single strike zones. This is achieved in accordance with a preferred embodiment of the present invention, as illustrated in FIG. 7. The porous member 13 has a height or width 16 measured between a first edge 17 of the porous member and a second edge 18 of the porous member. An outer surface 15 of the porous member is in planar contact with an outer surface 20 of transfer roller 19. As illustrated in FIG. 7, transfer roller 19 has a height 21 extending between a first edge of the transfer roller 22 and a second edge of the transfer roller 23, that is greater than the height of the porous member 13. The height 16 of the porous member 13 is equal to a distance 31 between the first edge 25 of the ribbon and a distal edge 32 of the double strike zone 29. As the ribbon 11 moves in a M öbius loop past transfer roller 19, ink will be applied to the ribbon via the transfer roller along the height of the porous member 13. As a result, on a first pass of the ribbon, ink is provided to one of the single strike zones and to the double strike zone. On a second pass of the ribbon, the ribbon will be inverted given the characteristics of the Möbius loop, and ink will be applied again to the double strike zone, as well as to the other single strike zone. In this manner, twice as much ink is provided to the double strike zone 29 as to each of the single strike zones 27 and 28.

Figure 8:
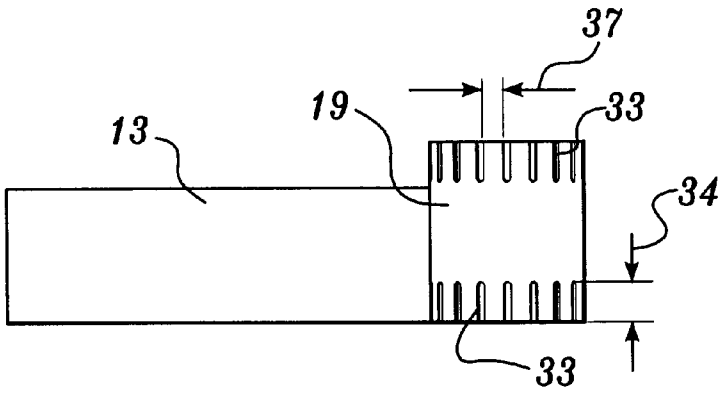
FIG. 8 is a front elevational view of a reinling apparatus provided in accordance with an alternative embodiment of the present invention.

If it is desired to provide more than twice as much ink to the double strike zone 29 as to each of the single strike zones 27 and 28, the transfer roller 19 is provided with a plurality of slots 33 spaced circumferentially around an outer surface of the transfer roller. Each of the slots extends laterally inward from one of the first and second edges of the transfer roller. Although the transfer roller 19 in FIG. 8 is illustrated with slots 33 extending inward from both the first edge 22 and second edge 23 of the transfer roller, it will be understood that it is only necessary to provide slots along the edge that will be in contact with ink from porous member 13. In a preferred embodiment, each of the slots 33 has a length 34 equal to the distance 35 between the first edge 25 of the ribbon and a distal edge 36 of the first single strike zone 27. As the ribbon moves in a Möbius loop past the transfer roller illustrated in FIG. 8, more than twice as much ink is provided to the double strike zone 29 as to each of the single strike zones, given the gaps created by the presence of slots 33. The slots are provided circumferentially around the outer surface of the transfer roller in a selectively spaced manner having a selected distance 37 between each of the slots 33 to achieve a desired proportion of ink transfer to the double strike zone as compared to each of the single strike zones.

Figure 9:
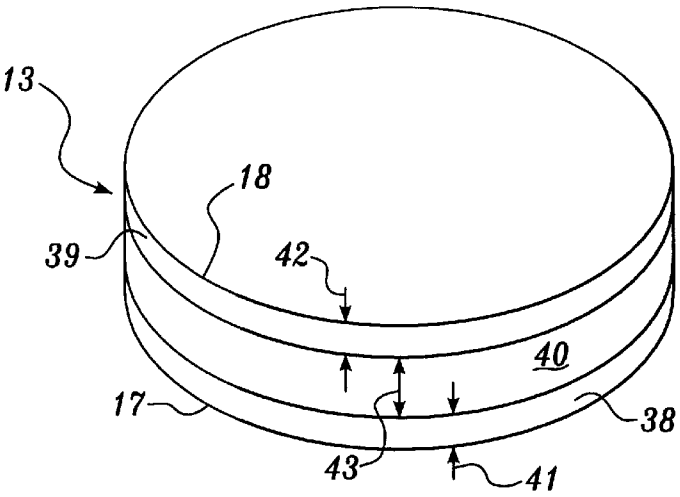
FIG. 9 is an isometric view of a porous member that forms a portion of a reinking apparatus provided in accordance with an alternative embodiment of the present invention.

In an alternative preferred embodiment, as illustrated in FIG. 9, a porous member 13 is provided with a first circumferential region 38 adjacent a first edge 17, a second circumferential region 39 adjacent the second edge 18, and a third circumferential region 40 extending laterally between the first and second circumferential regions. A width 41 of the first circumferential region 38 is equal to the distance 35 between the first edge of the ribbon and a distal edge 36 of the first single strike zone 27. The width 42 of the second circumferential region 39 is equal to the distance 44 between the second edge of the ribbon 26 and the distal edge of the second single strike zone 28, which distal edge is also the previously defined distal edge 32 of the double-strike zone 29. A width 43 of the third circumferential region 40 is equal to the width 46 of the double strike zone 29. In a preferred embodiment, the first and second circumferential regions are made of a material that is firmer than that of the third circumferential region. The rate of ink transfer is inversely proportional to the firmness of the porous member, and, as a result, more ink is provided to the double strike zone than to either of the single strike zones. The relative firmness of the first, second and third circumferential regions is selected to achieve a desired ratio of ink transfer to the double strike zone as compared to the single strike zones.

Figure 10:
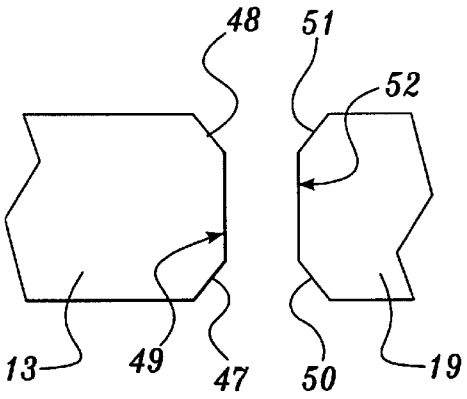
FIG. 10 is a partial front elevational view of a reinking apparatus provided in accordance with an alternative embodiment of the present invention.

In an alternative embodiment, as illustrated in FIG. 10, one or both of the outer surfaces of the porous member 13 and the transfer roller 19 are configured to provide a varying distribution of pressure across the interface between the porous member 13 and transfer roller 19. As illustrated in FIG. 10, the porous member 13 is chamfered in a first region 47 and a second region 48 on opposite sides of a central region 49. Similarly, the transfer roller 19 is chamfered in a first region 50 and a second region 51 on opposite sides of a central region 52. The pressure between the transfer roller and porous member will be greater at the interface between the central regions 49 and 52, resulting in a greater transfer of ink to the double strike zone of the ribbon. Although both the porous member and transfer roller may be given a selected profile, manufacturing may be simplified by profiling only the outer surface of the transfer roller 19.

Figure 11:
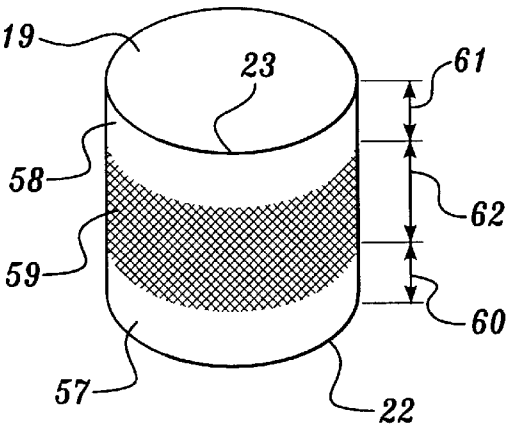
FIG. 11 is an isometric view of a transfer roller used in a reinking apparatus provided in accordance with an alternative embodiment of the present invention.

In an alternative embodiment, as illustrated in FIG. 11, the transfer roller 19 is provided with a first circumferential region 57 adjacent a first edge 22, a second circumferential region 58 adjacent a second edge 23, and a third circumferential region 59 extending laterally between the first and second circumferential regions. A width 60 of the first circumferential region 57 is equal to the distance 35 between the first edge of the ribbon and a distal edge 36 of the first single strike zone. A width 61 of the second circumferential region 58 is equal to the distance 44 between the second edge of the ribbon and a distal edge 45 of the second single strike zone, and a width 62 of the third circumferential region is equal to the width 46 of the double strike zone 29.

In a preferred embodiment, the outer surface of the third circumferential region is textured to be rougher than each of the outer surfaces of the first and second circumferential regions, such that more ink is provided to the double strike zone than to each of the first and second single strike zones. The relative roughness of the third circumferential region as compared to the first and second circumferential regions may be selected to achieve a desired ratio of ink transfer to the double strike zone as compared to the first and second single strike zones.

It will be understood that the various embodiments described herein may be used alone or in combination with each other. Also, the various embodiments may be used in conjunction with a vertically oriented system such as that illustrated in FIG. 1, or in a horizontally oriented system, as illustrated in FIG. 2. The various embodiments may also be used with a porous member that is saturated with ink, as illustrated in FIG. 1, or a porous member to which ink is pumped from an ink source, as illustrated in FIG. 2.

An improved apparatus for reinking a ribbon of a printer ribbon cartridge has been shown and described. From the foregoing, it will be appreciated that although embodiments of the invention have been described herein for purposes of illustration, various modifications may be made without deviating from the spirit of the invention. Thus, the present invention is not limited to the embodiments described herein, but rather is defined by the claims which follow.

The embodiments of the invention in which an exclusive property or privilege is claimed are defined as follows:

1. An apparatus for reinking a ribbon of a printer ribbon cartridge comprising:

a porous member in contact with a source of ink, an outer surface of the porous member having a width;

a transfer roller having an outer surface in planar contact with the outer surface of the porous member;

a ribbon having a width measured laterally from a first edge of the ribbon to a second edge of the ribbon, the ribbon having a first single-strike zone adjacent the first edge, a second single-strike zone adjacent the second edge, and a double-strike zone extending laterally between the first and second single-strike zones, the ribbon being in planar contact with the outer surface of the transfer roller and following a path of a Möbius loop through the printer ribbon cartridge; and wherein the width of the porous member is equal to a distance between the first edge of the ribbon and a distal edge of the double-strike zone, the porous member providing ink to the transfer roller and in turn to the ribbon along the width of the porous member, such that twice as much ink is provided to the double-strike zone as to each of the first and second single-strike zones.

2. The apparatus according to claim 1, wherein the ribbon moves into a horizontal orientation for a given period of time as the ribbon moves past a Möbius loop gate provided in the printer ribbon cartridge, and the transfer roller is positioned to rotate about a substantially horizontal axis and to contact and transfer ink to the ribbon while the ribbon is in the horizontal orientation.

3. The apparatus according to claim 1, wherein the outer surface of the transfer roller extends laterally from a first edge to a second edge, and a plurality of slots are provided circumferentially around the outer surface of the transfer roller, each of the slots extending laterally from at least one of the first and second edges of the transfer roller and having a length equal to a distance between the first edge of the ribbon and a distal edge of the first single-strike zone, the slots being in contact with the porous member and with the ribbon, such that more than twice as much ink is provided to the double-strike zone as to each of the single-strike zones.

4. The apparatus according to claim 3, wherein the slots are provided circumferentially around the outer surface of the transfer roller in a selectively spaced manner to achieve a desired proportion of ink transfer to the double-strike zone as compared to each of the single-strike zones.

5. The apparatus according to claim 3, wherein the ribbon moves into a horizontal orientation for a given period of time as the ribbon moves past a Möbius loop gate provided in the printer ribbon cartridge, and the transfer roller is positioned to rotate about a substantially horizontal axis and to contact and transfer ink to the ribbon while the ribbon is in the horizontal orientation.

6. An apparatus for reinking a ribbon of a printer ribbon cartridge comprising:

a porous member in contact with a source of ink and having an outer surface having a width extending laterally between a first edge and a second edge of the porous member;

a transfer roller having an outer surface in planar contact with the outer surface of the porous member;

a ribbon having a width measured laterally from a first edge of the ribbon to a second edge of the ribbon, the ribbon having a first single-strike zone adjacent the first edge of the ribbon, a second single-strike zone adjacent the second edge of the ribbon, and a double-strike zone extending laterally between the first and second single-strike zones, the ribbon being in planar contact with the outer surface of the transfer roller, the porous member providing ink to the transfer roller and in turn to the ribbon along the width of the porous member; and wherein the outer surface of the porous member is provided with a first circumferential region adjacent the first edge of the porous member, a second circumferential region adjacent the second edge of the porous member, and a third circumferential region extending laterally between the first and second circumferential regions, a width of the first circumferential region being equal to a distance between the first edge of the ribbon and a distal edge of the first single-strike zone, a width of the second circumferential region being equal to a distance between the second edge of the ribbon and a distal edge of the second single-strike zone, and a width of the third circumferential region being equal to a width of the double-strike zone of the ribbon, the first and second circumferential regions being firmer than the third circumferential region, such that more ink is provided to the double-strike zone than to each of the first and second single-strike zones.

7. The apparatus according to claim 6, wherein the relative firmness of the third circumferential region as compared to the firmness of the first and second circumferential regions is selected to provide a desired proportion of ink transfer to the double-strike zone as compared to the first and second single-strike zones.

8. The apparatus according to claim 6, wherein the ribbon moves into a horizontal orientation for a given period of time as the ribbon moves past a Möbius loop gate provided in the printer ribbon cartridge, and the transfer roller is positioned to rotate about a substantially horizontal axis and to contact and transfer ink to the ribbon while the ribbon is in the horizontal orientation.

9. An apparatus for reinking a ribbon of a printer ribbon cartridge comprising:

a porous member in contact with a source of ink and having an outer surface having a width extending laterally between a first edge and a second edge of the porous member;

a transfer roller having an outer surface in planar contact with the outer surface of the porous member;

a ribbon having a width measured laterally from a first edge of the ribbon to a second edge of the ribbon, the ribbon having a first single-strike zone adjacent the first edge of the ribbon, a second single-strike zone adjacent the second edge of the ribbon, and a double-strike zone extending laterally between the first and second single-strike zones, the ribbon being in planar contact with the outer surface of the transfer roller, the porous member providing ink to the transfer roller and in turn to the ribbon along a height of the porous member;

wherein one or both of the outer surfaces of the porous member and the transfer roller are chamfered in a first region and a second region provided on opposite sides of a central region such that pressure applied between the porous member and the transfer roller varies along the width of the porous member, with greater pressure being applied in the central region than in either of the first and second regions, such that more ink is applied to the double-strike zone of the ribbon than to either of the first and second single-strike zones.

10. The apparatus according to claim 9, wherein the ribbon moves into a horizontal orientation for a given period of time as the ribbon moves past a Möbius loop gate provided in the printer ribbon cartridge, and the transfer roller is positioned to rotate about a substantially horizontal axis and to contact and transfer ink to the ribbon while the ribbon is in the horizontal orientation.

11. An apparatus for reinking a ribbon of a printer ribbon cartridge comprising:

a porous member in contact with a source of ink and having an outer surface;

a transfer roller having an outer surface extending laterally between a first edge and a second edge of the transfer roller, the outer surface of the transfer roller being in planar contact with the outer surface of the porous member;

a ribbon having a width measured laterally from a first edge of the ribbon to a second edge of the ribbon, the ribbon having a first single-strike zone adjacent the first edge of the ribbon, a second single-strike zone adjacent the second edge of the ribbon, and a double-strike zone extending laterally between the first and second single-strike zones, the ribbon being in planar contact with the outer surface of the transfer roller, the porous member providing ink to the transfer roller and to the ribbon along a width of the porous member; and wherein the outer surface of the transfer roller is provided with a first circumferential region adjacent the first edge of the transfer roller, a second circumferential region adjacent the second edge of the transfer roller, and a third circumferential region extending laterally between the first and second circumferential regions, a width of the first circumferential region being equal to a distance between the first edge of the ribbon and a distal edge of the first single-strike zone, a width of the second circumferential region being equal to a distance between the second edge of the ribbon and a distal edge of the second single-strike zone, and a width of the third circumferential region being equal to a width of the double-strike zone of the ribbon, the third circumferential region being rougher than each of the first and second circumferential regions, such that more ink is provided to the double-strike zone than to each of the first and second single-strike zones.

12. The apparatus according to claim 11, wherein the ribbon moves into a horizontal orientation for a given period of time as the ribbon moves past a Möbius loop gate provided in the printer ribbon cartridge, and the transfer roller is positioned to rotate about a substantially horizontal axis and to contact and transfer ink to the ribbon while the ribbon is in the horizontal orientation.

13. An apparatus for reinking a ribbon of a printer ribbon cartridge comprising:

a porous member in contact with a source of ink and having an outer surface;

a transfer roller having an outer surface in planar contact with the outer surface of the porous member;

a ribbon having a width measured laterally from a first edge of the ribbon to a second edge of the ribbon, the ribbon following a path of a Möbius loop through the printer ribbon cartridge such that the ribbon moves into a horizontal orientation for a given period of time as the ribbon moves past a first Möbius loop gate provided in the printer ribbon cartridge; and the transfer roller and porous member are provided beneath the ribbon and the transfer roller is positioned to rotate about a substantially horizontal axis and to contact the ribbon while the ribbon is in the horizontal orientation, a quantity of ink moving upward through the porous member against gravity, the transfer roller transferring ink from a top surface of the porous member to the ribbon while the ribbon is in the horizontal orientation.

14. The apparatus according to claim 13, wherein the porous member is provided in a box, the transfer roller is pivotally mounted to an upper region of the box, and the first Möbius loop gate and a second Möbius loop gate are coupled to the box.

15. An apparatus for reinking a ribbon of a printer ribbon cartridge comprising:

a source of ink provided in the printer ribbon cartridge;

a pump in fluid communication with the source of ink and with a porous member that is stationary, the pump causing ink to flow from the source of ink to the porous member, the porous member having an outer surface;

a transfer roller rotatably mounted in the printer ribbon cartridge and having an outer surface in planar contact with the outer surface of the porous member;

a ribbon having a width measured laterally from a first edge of the ribbon to a second edge of the ribbon, the ribbon having a first single-strike zone adjacent the first edge of the ribbon, a second single-strike zone adjacent the second edge of the ribbon, and a double-strike zone extending laterally between the first and second single-strike zones, the ribbon being in planar contact with the outer surface of the transfer roller, the porous member providing ink to the transfer roller and in turn to the ribbon along a width of the porous member; and wherein the ribbon follows a path of a Möbius loop through the printer ribbon cartridge, and wherein a width of the porous member is equal to a distance between the first edge of the ribbon and a distal edge of the double-strike zone, the porous member providing ink to the transfer roller and in turn to the ribbon along the width of the porous member, such that twice as much ink is provided to the double-strike zone as to each of the first and second single-strike zones.

16. The apparatus according to claim 15, wherein the ribbon moves into a horizontal orientation for a given period of time as the ribbon moves past a Möbius loop gate provided in the printer ribbon cartridge, and the transfer roller is positioned to rotate about a substantially horizontal axis and to contact and transfer ink to the ribbon while the ribbon is in the horizontal orientation.

17. The apparatus according to claim 15, wherein the outer surface of the transfer roller extends laterally from a first edge to a second edge, and a plurality of slots are provided circumferentially around the outer surface of the transfer roller, each of the slots extending laterally from at least one of the first and second edges of the transfer roller and having a length equal to a distance between the first edge of the ribbon and a distal edge of the first single-strike zone, the slots being in contact with the porous member and with the ribbon, such that more than twice as much ink is provided to the double-strike zone as to each of the single-strike zones.

18. An apparatus for reinking a ribbon of a printer ribbon cartridge comprising:

a source of ink provided in the printer ribbon cartridge;

a pump in fluid communication with the source of ink and with a porous member that is stationary, the pump causing ink to flow from the source of ink to the porous member, the porous member having an outer surface;

a transfer roller rotatably mounted in the printer ribbon cartridge and having an outer surface in planar contact with the outer surface of the porous member;

a ribbon having a width measured laterally from a first edge of the ribbon to a second edge of the ribbon, the ribbon having a first single-strike zone adjacent the first edge of the ribbon, a second single-strike zone adjacent the second edge of the ribbon, and a double-strike zone extending laterally between the first and second single-strike zones, the ribbon being in planar contact with the outer surface of the transfer roller, the porous member providing ink to the transfer roller and in turn to the ribbon along a width of the porous member; and wherein the outer surface of the porous member is provided with a first circumferential region adjacent the first edge of the porous member, a second circumferential region adjacent the second edge of the porous member, and a third circumferential region extending laterally between the first and second circumferential regions, a width of the first circumferential region being equal to a distance between the first edge of the ribbon and a distal edge of the first single-strike zone, a width of the second circumferential region being equal to a distance between the second edge of the ribbon and a distal edge of the second single-strike zone, and a width of the third circumferential region being equal to a width of the double-strike zone of the ribbon, the first and second circumferential regions being firmer than the third circumferential region, such that more ink is provided to the double-strike zone than to each of the first and second single-strike zones.

19. An apparatus for reinking a ribbon of a printer ribbon cartridge comprising:

a source of ink provided in the printer ribbon cartridge;

a pump in fluid communication with the source of ink and with a porous member that is stationary, the pump causing ink to flow from the source of ink to the porous member, the porous member having an outer surface;

a transfer roller rotatably mounted in the printer ribbon cartridge and having an outer surface in planar contact with the outer surface of the porous member;

a ribbon having a width measured laterally from a first edge of the ribbon to a second edge of the ribbon, the ribbon having a first single-strike zone adjacent the first edge of the ribbon, a second single-strike zone adjacent the second edge of the ribbon, and a double-strike zone extending laterally between the first and second single-strike zones, the ribbon being in planar contact with the outer surface of the transfer roller, the porous member providing ink to the transfer roller and in turn to the ribbon along a width of the porous member; and wherein one or both of the outer surfaces of the porous member and the transfer roller are chamfered in a first region and a second region provided on opposite sides of a central region such that pressure applied between the porous member and the transfer roller varies along the width of the porous member, with greater pressure being applied in the central region than in either of the first and second regions, such that more ink is applied to the double-strike zone of the ribbon than to either of the first and second single-strike zones.

20. An apparatus for reinking a ribbon of a printer ribbon cartridge comprising:

a source of ink provided in the printer ribbon cartridge;

a pump in fluid communication with the source of ink and with a porous member that is stationary, the pump causing ink to flow from the source of ink to the porous member, the porous member having an outer surface;

a transfer roller rotatably mounted in the printer ribbon cartridge and having an outer surface in planar contact with the outer surface of the porous member;

a ribbon having a width measured laterally from a first edge of the ribbon to a second edge of the ribbon, the ribbon having a first single-strike zone adjacent the first edge of the ribbon, a second single-strike zone adjacent the second edge of the ribbon, and a double-strike zone extending laterally between the first and second single-strike zones, the ribbon being in planar contact with the outer surface of the transfer roller, the porous member providing ink to the transfer roller and in turn to the ribbon along a width of the porous member; and wherein the outer surface of the transfer roller is provided with a first circumferential region adjacent a first edge of the transfer roller, a second circumferential region adjacent a second edge of the transfer roller, and a third circumferential region extending laterally between the first and second circumferential regions, a width of the first circumferential region being equal to a distance between the first edge of the ribbon and a distal edge of the first single-strike zone, a width of the second circumferential region being equal to a distance between the second edge of the ribbon and a distal edge of the second single-strike zone, and a width of the third circumferential region being equal to a width of the double-strike zone of the ribbon, the third circumferential region being rougher than each of the first and second circumferential regions, such that more ink is provided to the double-strike zone than to each of the first and second single-strike zones.

* * * * *